US010627747B2

(12) United States Patent
Onishi et al.

(10) Patent No.: US 10,627,747 B2
(45) Date of Patent: Apr. 21, 2020

(54) IMAGE FORMING APPARATUS AND IMAGE FORMING PROGRAM FOR REDUCING OCCURRENCES OF COLOR MISREGISTRATION AND DENSITY UNEVENNESS USING FLUCTUATION PATTERN OF DIFFERENCE VALUES

(71) Applicant: Konica Minolta, Inc., Chiyoda-ku, Tokyo (JP)

(72) Inventors: Jun Onishi, Hino (JP); Masahito Takano, Koganei (JP); Takashi Fujiwara, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/265,100

(22) Filed: Feb. 1, 2019

(65) Prior Publication Data

US 2019/0243289 A1 Aug. 8, 2019

(30) Foreign Application Priority Data

Feb. 5, 2018 (JP) ..... 2018-018070

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS

2009/0169225 A1* 7/2009 Murata ..... G03G 15/0131 399/46
2009/0324262 A1* 12/2009 Matsuda ..... G03G 15/5008 399/36
2010/0327797 A1* 12/2010 Maeda ..... G03G 15/5008 399/53
2015/0261117 A1* 9/2015 Suzuki ..... G03G 15/043 347/118

FOREIGN PATENT DOCUMENTS

JP 2008094573 A 4/2008

* cited by examiner

*Primary Examiner* — Susan S Lee
(74) *Attorney, Agent, or Firm* — Cantor Colburn LLP

(57) ABSTRACT

An image forming apparatus includes: a hardware processor that performs feedforward control on a motor; a driving roller that drives an intermediate transfer belt for transferring a toner image; a drive transmission system that transmits a driving force of the motor; a first detector that detects a speed of a driving shaft of the motor; a second detector that detects a speed of a driving shaft of the drive transmission system; and a storage that stores a plurality of sets of control data having different conformity states, wherein the plurality of sets of control data include pairs of a feedforward operation pattern and a drive transmission system deformation pattern, the drive transmission system deformation pattern corresponds to a fluctuation pattern of difference values, and the hardware processor compares the fluctuation pattern of difference values with the plurality of sets of control data.

12 Claims, 4 Drawing Sheets

IMAGE FORMING APPARATUS AND IMAGE FORMING PROGRAM FOR REDUCING OCCURRENCES OF COLOR MISREGISTRATION AND DENSITY UNEVENNESS USING FLUCTUATION PATTERN OF DIFFERENCE VALUES

CROSS-REFERENCE TO RELATED APPLICATION

The present application claims priority under 35 U.S.C. § 119 to Japanese Patent Application No. 2018-018070, filed on Feb. 5, 2018, the entirety of which is hereby incorporated by reference herein and forms a part of the specification.

BACKGROUND

Technological Field

The present invention relates to an image forming apparatus and an image forming program.

Description of the Related Art

An image forming apparatus includes an image forming unit, a transfer unit, and a fixing unit. The image forming unit includes a photosensitive drum on which an electrostatic latent image is formed, and forms a toner image on a paper sheet P as a recording medium, using an electrophotographic process. The transfer unit has an intermediate transfer belt onto which the toner image is transferred, and transfers the toner image onto the paper sheet conveyed thereto. The fixing unit fixes the toner image to the paper sheet.

Meanwhile, in a case where a difference is caused between the sheet conveyance velocity at the transfer unit and the sheet conveyance velocity at the fixing unit due to component tolerance, component wear, a temperature change, sheet rigidity, sheet length, or the like, a large conveyance reaction force is generated on the intermediate transfer belt. This is particularly conspicuous in a case where the paper sheet is thick paper. In such a case, the moving speed of the intermediate transfer belt is made to fluctuate, and color misregistration and density unevenness that will lead to an image defect are caused in the toner image.

To counter this, JP 2008-94573 A discloses a technology by which a section for detecting the angular velocity of the driving roller of an intermediate transfer belt is provided, and fluctuations in the moving speed of the driving roller are canceled by feedforward control based on the result of the detection.

However, fluctuations in the angular velocity of the driving roller of the intermediate transfer belt do not directly represent fluctuations in the moving speed of the intermediate transfer belt, and probably differ from the fluctuations in the moving speed of the intermediate transfer belt. Therefore, the effect to reduce fluctuations in the moving speed of the intermediate transfer belt is limited, and occurrences of color misregistration and density unevenness are not effectively reduced.

SUMMARY

The present invention has been made to solve the problems with the above conventional technology, and an object of the present invention is to provide an image forming apparatus and an image forming program capable of effectively reducing occurrences of color misregistration and density unevenness due to fluctuations in the moving speed of the intermediate transfer belt.

To achieve the abovementioned object, according to an aspect of the present invention, an image forming apparatus reflecting one aspect of the present invention comprises:

a hardware processor that performs feedforward control on a motor in synchronization with conveyance of a paper sheet on which an image is to be formed;

a driving roller that drives an intermediate transfer belt for transferring a toner image onto the paper sheet;

a drive transmission system that transmits a driving force of the motor to the driving roller;

a first detector that detects a speed of a driving shaft of the motor;

a second detector that detects a speed of a driving shaft of the drive transmission system; and a storage that stores a plurality of sets of control data having different conformity states, wherein the plurality of sets of control data include pairs of a feedforward operation pattern and a drive transmission system deformation pattern synchronized with the feedforward operation pattern, the drive transmission system deformation pattern corresponds to a fluctuation pattern of difference values between the speed of the driving shaft of the motor and the speed of the driving shaft of the drive transmission system, and the hardware processor compares the fluctuation pattern of difference values between the speed detected by the first detector and the speed detected by the second detector with the plurality of sets of control data, to select a feedforward operation pattern in an appropriate conformity state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
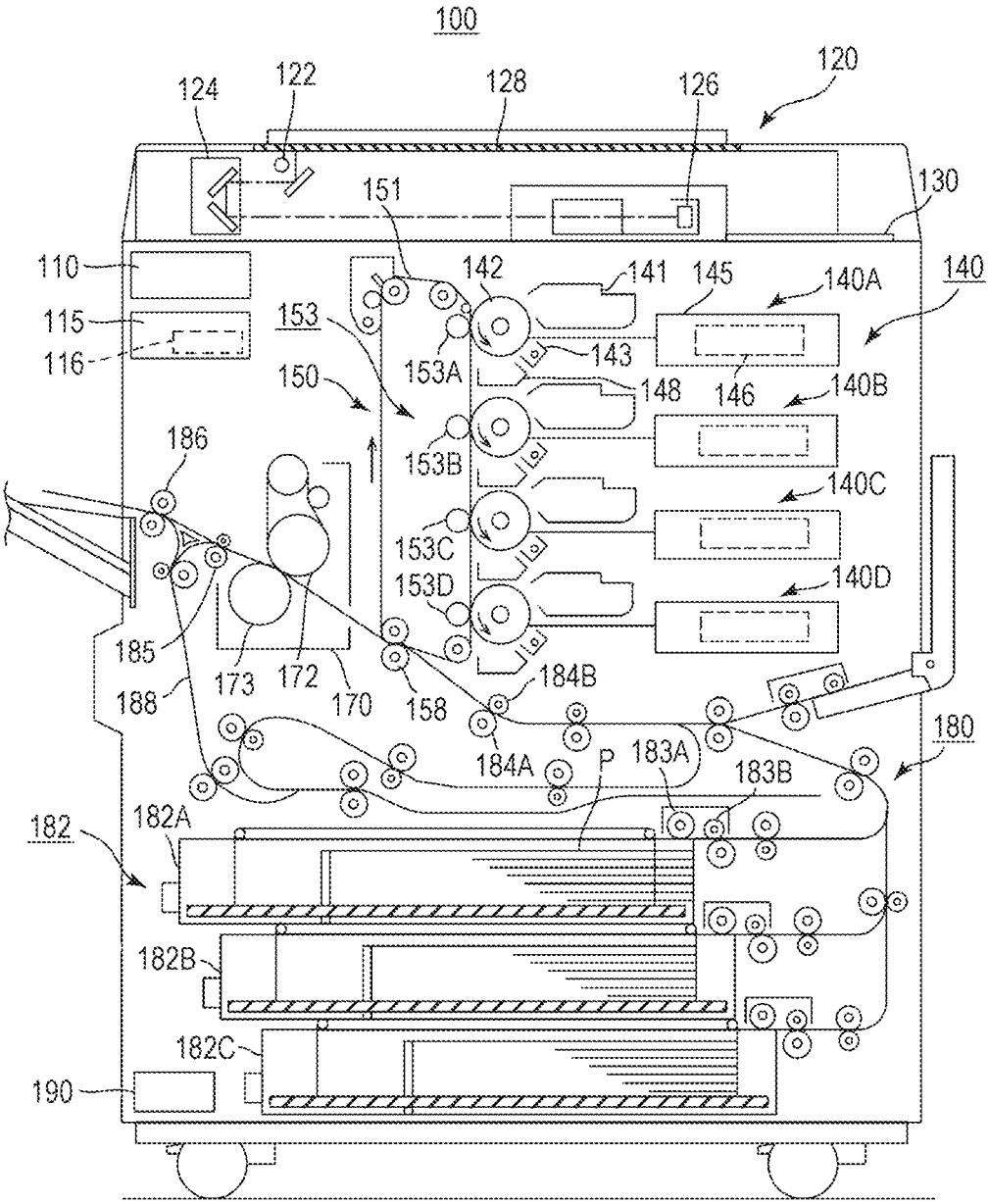
FIG. 1 is a schematic view for explaining an image forming apparatus according to an embodiment of the present invention.

Hereinafter, one or more embodiments of the present invention will be described with reference to the drawings. However, the scope of the invention is not limited to the disclosed embodiments. The dimensional ratios in the drawings are increased for ease of explanation, and may differ from the actual dimensional ratios.

FIG. 1 is a cross-sectional view for explaining an image forming apparatus according to an embodiment of the present invention.

The image forming apparatus 100 shown in FIG. 1 is a multi-function peripheral (MFP) having a copy function, a printer function, and a scan function, for example, and is used to form (print) an image on a paper sheet as a recording medium, using image data generated from a received print job or scanned document image.

The image forming apparatus 100 includes a controller 110, a storage 115, an image reading unit 120, an operation display unit 130, an image forming unit 140, a transfer unit 150, a fixing unit 170, a sheet conveying unit 180, and a communication interface 190. In FIG. 1, driving parts such as a motor and some of the rollers are not shown.

The controller 110 is a control circuit formed with a microprocessor (a central processing unit (CPU)), an application specific integrated circuit (ASIC), or the like that controls the above components and performs various kinds of arithmetic processing in accordance with programs. Each function of the image forming apparatus 100 is achieved by the controller 110 executing each corresponding program.

The storage 115 is a storage section formed with an appropriate combination of a read only memory (ROM), a random access memory (RAM), and a hard disk drive (HDD). The ROM is a read-only storage device that stores various kinds of programs and various kinds of data. The RAM is a high-speed storage device that temporarily stores programs and data, serving as a workspace. The HDD is a large-capacity storage device that stores various kinds of programs and various kinds of data.

The data to be stored is learning data, image data, a print job, and the like. The learning data includes a plurality of sets of control data having different conformity states, and is used in an image forming program 116. The image data is scanned document data acquired by the image reading unit 120, for example. The print job includes print data and print setting data in the page description language (PDL) format, for example, and is acquired via the communication interface 190.

The programs to be stored include the image forming program 116 and a raster image processing (RIP) program, for example.

The image forming program 116 has a function of controlling the drive motor of the intermediate transfer belt (described later) of the transfer unit 150 in synchronization with the conveyance of the paper sheet on which the image is to be formed. The image forming program 116 is capable of recuing occurrences of color misregistration and density unevenness due to fluctuations in the moving speed of the intermediate transfer belt. The RIP processing program is a program for converting image data into raster image data (bitmap data) to be used in the image forming unit 140.

The image reading unit 120 is used to generate the image data of a document, and includes a light source 122, an optical system 124, and an imaging device 126. The light source 122 emits light onto the document placed on a reading surface 128, and the light reflected by the document forms an image in the imaging device 126 via the optical system 124. At this point, the imaging device 126 has moved to the reading position. The imaging device 126 is formed with a line image sensor, for example, and generates an electrical signal in accordance with the intensity of the reflected light (or performs photoelectric conversion). The generated electrical signal is input to the image forming unit 140 after image processing. The image processing includes A/D conversion, shading correction, a filtering process, an image compression process, and the like. The image reading unit 120 may also include an auto document feeder (ADF) 122, for example.

The operation display unit 130 is formed with a liquid crystal display (LCD) and a keyboard, for example, and also serves as an output section and an input section. The LCD is used for presenting the device configuration, the progress of a print job, error occurrences, the currently alterable settings, and the like to the user. The keyboard has keys including a selection key for designating the size of the paper sheet P, a numeric keypad for setting the number of copies and the like, a start key for issuing an operation start instruction, a stop key for issuing an operation stop instruction, and the like. The keyboard is used by the user to input characters, perform various kinds of setting, and issuing (inputting) various kinds of instructions such as a start instruction.

The image forming unit 140 uses an electrophotographic process, and is used for forming an image on the paper sheet P as a recording medium. The image forming unit 140 includes an image formation unit 140A that forms a yellow (Y) image, an image formation unit 140B that forms a magenta (M) image, an image formation unit 140C that forms a cyan (C) image, and an image formation unit 140D that forms a black (K) image.

The respective units in the image forming unit 140 each include a developing device 141, a photosensitive drum 142, a charging unit 143, an optical writing unit 145, and a cleaning device 148.

Each developing device 141 develops an electrostatic latent image formed on the corresponding photosensitive drum 142, and visualizes the electrostatic latent image with toner. The developing devices 141 develop monochrome toner images corresponding to yellow, magenta, cyan, and black on the respective photosensitive drums 142 of the image formation units 140A, 140B, 140C, and 140D.

Each photosensitive drum 142 is an image carrier including a photosensitive layer made of a resin such as polycarbonate containing an organic photoconductor (OPC), and is designed to rotate at a predetermined speed. Each charging unit 143 is formed with a corona discharge electrode disposed in the vicinity of the corresponding photosensitive drum 142, and electrically charges the surface of the photosensitive drum 142 with generated ions.

Each optical writing unit 145 has a scanning optical device 146 incorporated thereinto. Each optical writing unit 145 exposes the corresponding electrically-charged photosensitive drum 142 in accordance with raster image data, to lower the potential of the exposed portion, and form the charge pattern (electrostatic latent image) corresponding to the image data.

Each cleaning device 148 is used to maintain the surface of the corresponding photosensitive drum 142 in a preferred state by scraping off (removing) the toner remaining on the surface of the corresponding photosensitive drum 142 after the toner image is transferred onto the intermediate transfer belt 151 described later.

The transfer unit 150 is used to form a color image by superimposing the toner images in the respective colors (yellow, magenta, cyan, and black) formed by the image formation units 140A through 140D, and transfer the toner image onto the paper sheet P conveyed thereto.

The fixing unit 170 is used for fixing the color image transferred onto the paper sheet P, and includes a heating roller (fixing roller) 172 and a pressure roller 173. When the paper sheet P passes between the heating roller 172 and the pressure roller 173, pressure and heat are applied to the paper sheet P, to melt the toner and fix the color image to the paper sheet P.

The sheet conveying unit 180 includes a sheet feeder unit 182, a timing roller 184A, an opposing roller 184B, fixing conveyance rollers 185, sheet ejecting rollers 186, and a sheet reversing unit 188.

The sheet feeder unit 182 includes sheet feed trays 182A through 182C that store paper sheets P, a feed roller 183A, and separation rollers 183B. The feed roller 183A and the separation rollers 183B send the paper sheets one by one from the sheet feed trays 182A through 182C into the conveyance path.

The timing roller 184A and the opposing roller 184B form a pair, and convey each paper sheet P fed from the sheet feeder unit 182 to a secondary transfer unit 158. The fixing conveyance rollers 185 convey each paper sheet P having passed through the secondary transfer unit 158 and the fixing unit 170, toward the sheet ejecting rollers 186. The sheet ejecting rollers 186 eject each conveyed paper sheet P out of the apparatus.

The sheet reversing unit 188 is used for reversing and ejecting a paper sheet P or forming images on both surfaces of a paper sheet P, by introducing a paper sheet P having passed through the fixing conveyance rollers 185 into the conveyance path between the sheet feed trays 182A through 182C and the sheet ejecting rollers 186, not into the conveyance path toward the sheet ejecting rollers 186.

The communication interface 190 is an expansion device (LAN board) for adding a communication function for performing transmission and reception of data such as a print job via a network, to the image forming apparatus 100. The network may be a local area network (LAN), a wide area network (WAN) formed with LANs connected to one another by a dedicated line, the Internet, or a combination of these networks. The LAN standard is Ethernet (registered trademark), a token ring, or a fiber-distributed data interface (FDDI), for example. The communication protocol is transmission control protocol/internet protocol (TCP/IP), for example.

Next, the transfer unit is described in detail.

Figure 2:
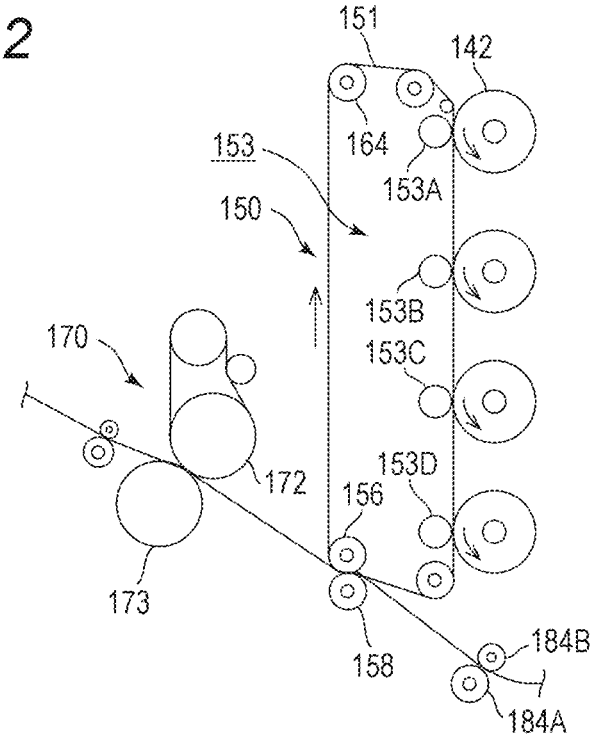
FIG. 2 is a side view for explaining the transfer unit shown in FIG. 1.
Figure 3:
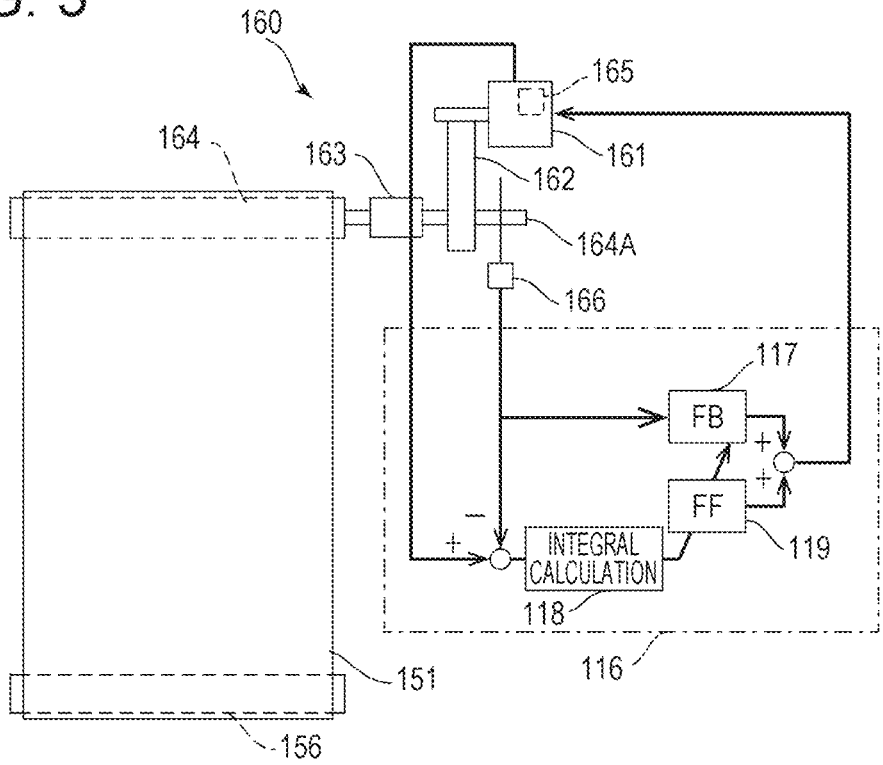
FIG. 3 is a schematic view for explaining the driving unit of the intermediate transfer belt provided in the transfer unit.

FIG. 2 is a side view for explaining the transfer unit shown in FIG. 1. FIG. 3 is a schematic view for explaining the driving unit of the intermediate transfer belt disposed in the transfer unit.

As shown in FIG. 2 and FIG. 3, the transfer unit 150 includes an intermediate transfer belt 151, a primary transfer unit 153, the secondary transfer unit 158, an intermediate transfer belt driving unit 160, a feedback control calculating unit 117, an integral calculating unit 118, and a feedforward control calculating unit 119. In the description below, feedback and feedforward will be referred to as FB and FF, respectively, where appropriate. In this embodiment, the FB control calculating unit 117, the integral calculating unit 118, and the FF control calculating unit 119 are realized by the image forming program 116.

The intermediate transfer belt 151 is wound around the primary transfer unit 153 and rollers, and is movably supported. The primary transfer unit 153 includes primary transfer modules 153A, 153B, 153C, and 153D corresponding to yellow, magenta, cyan, and black. The secondary transfer unit 158 is formed with a roller disposed on the outer side of the intermediate transfer belt 151, and is positioned so that a paper sheet P can pass between the secondary transfer unit 158 and the intermediate transfer belt 151.

With this configuration, the toner images in the respective colors formed by the image formation units 140A through 140D are sequentially transferred onto the intermediate transfer belt 151 by the primary transfer modules 153A through 153D, and a color toner image formed with the superimposed yellow, magenta, cyan, and black layers is formed. The formed toner image is transferred onto the paper sheet P conveyed thereto by the secondary transfer unit 158. Reference numeral 156 indicates a roller (opposing roller) disposed to face the secondary transfer unit 158, and is paired with the secondary transfer unit 158.

The intermediate transfer belt driving unit 160 has a driving motor 161, a drive transmission gear 162, a coupling 163, a driving roller 164, a first encoder 165, and a second encoder 166.

The driving motor 161 is the drive source for the intermediate transfer belt 151, and pulse width modulation (PWM) control for turning on and off the excitation voltage at a high frequency is applied. The duty ratio of the PWM control is controlled by FB control calculation and FF control calculation (a drive control signal of the driving motor 161 is generated).

The drive transmission gear 162 is disposed between the driving motor 161 and the coupling 163, and is used for transmitting rotation of the driving motor 161 to the coupling 163. The coupling 163 is connected to an output shaft 164A of the driving roller 164 disposed on the inner side of the intermediate transfer belt 151.

With this arrangement, the driving motor 161 can drive the intermediate transfer belt 151 by rotating the driving roller 164 via the drive transmission gear 162 and the coupling 163. In this embodiment, the drive transmission system for transmitting the driving force of the driving motor 161 to the driving roller 164 is formed with the drive transmission gear 162, the coupling 163, and the output shaft 164A of the driving roller 164.

The first encoder 165 is a first detector designed to detect the rotational speed of the driving shaft of the driving motor 161. The driving motor 161 is designed to output a frequency generator (FG) signal indicating a frequency proportional to the rotational speed of the driving shaft. In other words, the first encoder 165 is integrated with the driving motor 161. Alternatively, the first encoder 165 may be formed as an independent component.

The second encoder 166 is a second detector designed to detect the rotational speed of the output shaft 164A of the driving roller 164 connected to the coupling 163. The second encoder 166 does not necessarily detect the rotational speed of the output shaft 164A of the driving roller 164, but may be designed to detect the rotational speed of some other driving shaft (other than the output shaft 164A) of the drive transmission system.

The FB control calculating unit 117 performs FB control calculation, in accordance with the rotational speed of the driving shaft of the driving motor 161 detected by the first encoder 165 and the rotational speed of the output shaft 164A of the driving roller 164 detected by the second encoder 166. The FB control calculation is used for controlling the duty ratio of the PWM control on the driving motor 161.

The integral calculating unit 118 performs integral calculation of difference values between the rotational speed of the driving shaft of the driving motor 161 detected by the first encoder 165 and the rotational speed of the output shaft 164A of the driving roller 164 detected by the second encoder 166. As a result, the variation pattern of the difference values during operation is detected. In this description, the rotational speed of the driving shaft of the driving motor 161 and the rotational speed of the output shaft 164A of the driving roller 164 are designed to be (ideally) the same. However, if the designed rotational speeds differ depending on the gear ratio of the gear train provided in the drive transmission system, it is also possible to calculate the difference value after normalizing the rotational speeds.

The FF control calculating unit 119 selects an FF operation pattern in an appropriate conformity state (or performs FF control calculation), by comparing the pattern of the difference values detected during operation with the learning data stored in the storage 115. Like the FB control calculation, the FF control calculation is used for controlling the duty ratio of the PWM control on the driving motor 161.

Next, the learning data and the selection of an FF operation pattern by the FF control calculating unit are described in detail.

Figure 4:
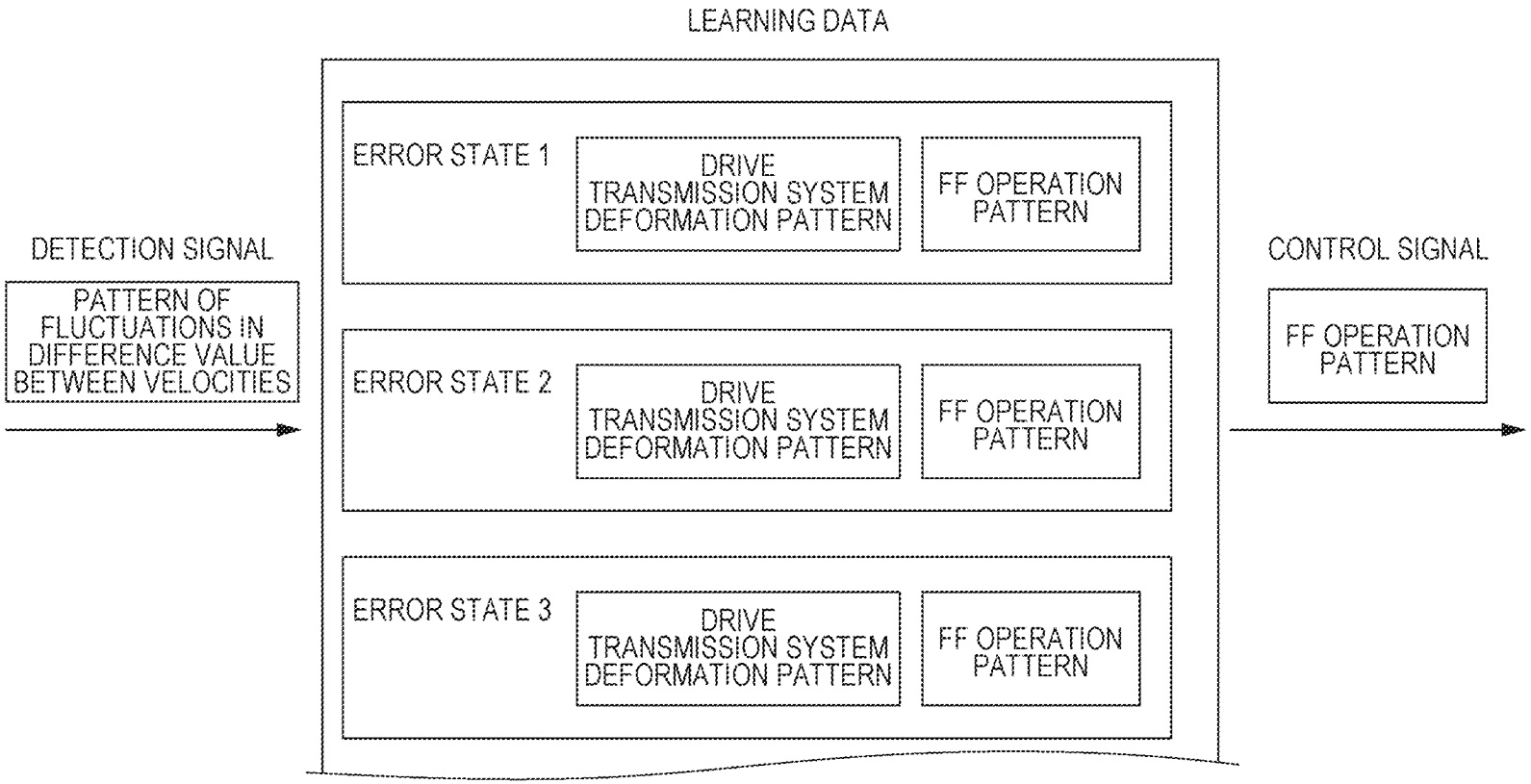
FIG. 4 is a block diagram for explaining the learning data stored in the storage shown in FIG. 1.

FIG. 4 is a block diagram for explaining the learning data stored in the storage shown in FIG. 1.

The learning data includes error state data formed with sets of control data having different conformity states. The different conformity states relate to sheet characteristics and/or the rotational speed (fixing conveyance velocity) of heating roller (fixing roller) 172, for example. The sheet characteristics include, for example, the thickness, weight (basis weight), and frictional properties of the paper sheet. The different conformity states are not limited to these properties, but may also relate to humidity and temperature, for example.

As shown in FIG. 4, the error state data includes pairs of an FF operation pattern and a drive transmission system deformation pattern synchronized with the FF operation pattern. The error state data is obtained in advance by iterative learning at the time of device development, for example. Note that the iterative learning is conducted with different conformity states.

The drive transmission system deformation pattern is a deformation pattern of the drive transmission system with various disturbance forces and response characteristics. In this embodiment, the drive transmission system deformation pattern corresponds to a fluctuation pattern of difference values between the rotational speed of the driving shaft of the driving motor 161 detected by the first encoder 165 and the rotational speed of the output shaft 164A of the driving roller 164 detected by the second encoder 166. The paired FF operation pattern is an appropriate (optimum) operation pattern for the drive transmission system deformation pattern.

In this embodiment, the FF operation pattern paired with the drive transmission system deformation pattern that is the same as or similar to the pattern of the difference values detected during operation is selected as the FF operation pattern in an appropriate conformity state. That is, an FF operation pattern in an appropriate conformity state is selected from among the FF operation patterns contained in the learning data (sets of error state data). Here, a machine learning algorithm is used in determining the sameness or similarity between patterns. The machine learning algorithm may be principal component analysis (PCA) or partial least squares (PLS), for example.

With this arrangement, in a case where the driving motor 161 of the intermediate transfer belt 151 is controlled with the selected FF operation pattern, it is possible to perform excellent FF control without lowering productivity, and effectively reduce occurrences of color misregistration and density unevenness due to fluctuations in the moving speed of the intermediate transfer belt 151.

For example, fluctuations in the moving speed of the intermediate transfer belt will lead to image defects such as color misregistration and density unevenness. Therefore, the speed of the intermediate transfer belt is detected, and the driving motor of the intermediate transfer belt is controlled, so that fluctuations in the moving speed of the intermediate transfer belt can be reduced.

The speed of the intermediate transfer belt is preferably detected at a position near the imaging unit (the primary transfer unit) of the intermediate transfer belt. In that case, however, a detection failure due to contamination by toner or the like is likely to occur. Further, in a case where a ladder-like marking is formed on the intermediate transfer belt and is used for speed detection, the cost of the intermediate transfer belt becomes higher. Furthermore, in a case where detection of the speed of a roller driven by the intermediate transfer belt is used, an error in speed detection due to slipping between the intermediate transfer belt and the driven roller cannot be avoided.

To avoid such problems, an FF operation pattern may be created in accordance with detection of color misregistration and density unevenness in images due to fluctuations in the moving speed of the intermediate transfer belt. However, if the fluctuation state (error state) of the moving speed of the intermediate transfer belt changes, the FF operation pattern created in advance does not match the fluctuation state. On the other hand, in a case where an FF operation pattern is re-created or corrected every time the fluctuation state of the moving speed of the intermediate transfer belt changes, there are damaged paper sheets or wasted paper sheets that cannot be used as products, and productivity will become lower.

To re-create or correct an FF operation pattern, the inverse model for obtaining the driving operation amount from the fluctuations in the moving speed of the intermediate transfer belt always has an error with respect to the actual characteristics. Therefore, it is necessary to reduce the error by iterative learning, but this will cause a decrease in productivity.

To counter this, FF operation patterns in various states may be prepared by iterative learning and be stored in advance, and these patterns may be used depending on error states. However, external disturbance and the response characteristics of the drive transmission system depend not only on manageable conditions such as the thickness of the paper sheet, but also on state changes, and the optimum FF operation pattern changes.

For example, in a case where the outer diameters of the rollers (upstream-side rollers) disposed on the upstream side of the transfer unit with respect to the sheet conveying direction and the outer diameters of the rollers (downstream-side rollers) disposed on the downstream side of the transfer unit change due to component tolerance, wear, or temperature changes, a velocity difference is caused between the conveyance velocity of the transfer unit (the intermediate transfer belt) and the conveyance velocity of the upstream-side rollers and the downstream-side rollers.

In a setting where a conveyance reaction force is instantly applied to the transfer unit and loosens the paper sheet when the paper sheet is pulled between the transfer unit and the upstream-side and the downstream-side rollers, a steady conveyance reaction force is generated if the paper sheet is thick paper having a high rigidity. Fluctuations in the conveyance reaction force depend not only on the conveyance velocity of the upstream-side rollers and the downstream-side rollers, but also on the sheet rigidity, the sheet length, the gripping state of the transfer unit, or the like, and the optimum FF operation pattern varies with combinations of these factors. Also, the responses of the velocity of the intermediate transfer belt to a conveyance reaction force and to a driving operation vary depending on the degree of contact between the photosensitive drums and the intermediate transfer belt. That is, the optimal FF operation pattern varies with the degree of contact.

To select an optimum FF operation pattern in spite of such uncontrollable state changes, a simple one-dimensional quantity such as the level of a fluctuation in the moving speed cannot be used, but a pattern of fluctuations in the moving speed during a certain period of time can be used.

However, in a case where a pattern of fluctuations in the moving speed at a specific position is used, the control operation pattern at the time of measurement affects the pattern of fluctuations in the moving speed. Therefore, it is difficult to make appropriate determination while separating the influence of conditions from the influence of states.

On the other hand, in a case where an encoder that detects the rotational speed of the driving shaft of the driving motor of the intermediate transfer belt, and an encoder that detects the rotational speed of the output shaft of the driving roller are provided, and difference values between speeds detected by the encoders are integrated, for example, it is possible to obtain the drive transmission system deformation pattern between the position of the driving shaft of the driving motor and the position of the output shaft of the driving roller. The drive transmission system deformation pattern (the difference value fluctuation pattern) is dominantly affected by external disturbance forces and the response characteristics of the drive transmission system, even if being accompanied by a certain delay. Accordingly, the influence of the control operation pattern is small.

For example, in a situation where a paper sheet is pulled between the transfer unit and the rollers, the conveyance reaction force of the transfer unit is proportional to the difference between the velocity of the upstream-side rollers and the downstream-side rollers and the velocity of the transfer unit, and the control operation pattern compensates for drive transmission system deformation. Accordingly, the compensation speed of the derivative amount becomes 0, except for the rising and falling phases of deformation. Because of this, the conveyance velocity difference, the conveyance reaction force, and the drive transmission system deformation pattern are hardly affected by the control operation pattern.

In a situation where a paper sheet is pushed, on the other hand, the conveyance reaction force of the transfer unit is the product of the sheet slack amount and the sheet rigidity, and is also the product of the drive transmission system deformation to be compensated for and the drive rigidity. The sheet rigidity is lower than the drive rigidity, and the sheet slack amount is larger than the drive transmission system deformation. Because of this, the sheet slack amount, the conveyance reaction force, and the drive transmission system deformation pattern are hardly affected by the control operation pattern in this case.

As described above, from the pattern of difference values, it is possible to determine an uncontrollable state change, regardless of the control operation pattern at that point of time. Thus, in this embodiment, the FF operation pattern paired with the drive transmission system deformation pattern that is the same as or similar to the pattern of the difference values detected during operation is selected as the FF operation pattern in an appropriate conformity state.

Note that the FF operation pattern in an appropriate conformity state is not necessarily selected from among the FF operation patterns contained in the learning data, but may be an FF operation pattern obtained by interpolating the FF operation patterns contained in the learning data.

Next, an image forming method according to this embodiment is described.

Figure 5:
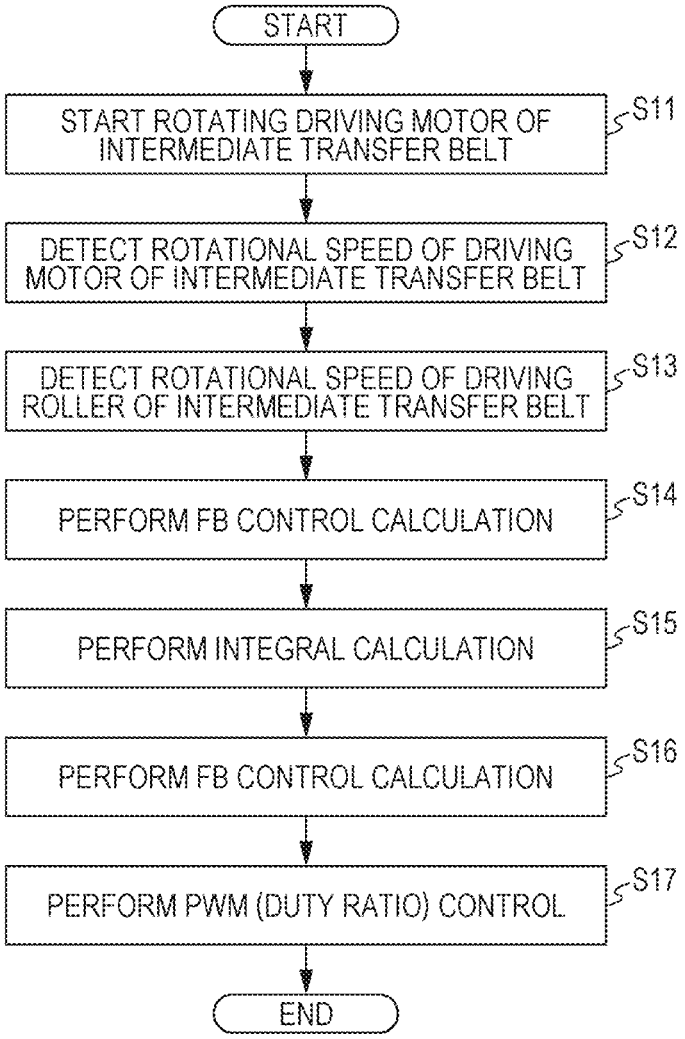
FIG. 5 is a flowchart for explaining an image forming method according to an embodiment of the present invention.

FIG. 5 is a flowchart for explaining the image forming method according to the embodiment of the present invention. The algorithm shown by the flowchart in FIG. 5 is stored as the image forming program 116, and is executed by the controller 110.

First, as shown in FIG. 5, the driving motor 161 of the intermediate transfer belt 151 is driven (step S11).

The rotation of the driving motor 161 is transmitted to the drive transmission gear 162, and the driving roller 164 is rotated via the coupling 163 (see FIG. 3). As a result, the intermediate transfer belt 151 is driven, the toner images formed on the photosensitive drums 142 are transferred onto the intermediate transfer belt 151 by primary transfer, and the color toner image is then transferred onto a paper sheet by the secondary transfer unit 158 (see FIG. 2). The timing of the paper sheet conveyance is controlled by the timing roller 184A, and the paper sheet is conveyed to the secondary transfer unit 158. The toner image transferred onto the paper sheet is then thermally fixed at the nip portion between the heating roller 172 and the pressure roller 173 of the fixing unit 170.

The rotational speed of the driving shaft of the driving motor 161 is detected by the first encoder 165 (step S12), and the rotational speed of the output shaft 164A of the driving roller 164 is detected by the second encoder 166 (step S13).

FB control calculation is performed in accordance with the rotational speed of the shaft of the driving motor 161 detected by the first encoder 165 and the rotational speed of the output shaft 164A of the driving roller 164 detected by the second encoder 166 (step S14).

Integral calculation is then performed on difference values between the rotational speed of the driving shaft of the driving motor 161 detected by the first encoder 165 and the rotational speed of the output shaft 164A of the driving roller 164 detected by the second encoder 166 (step S15). As a result, the variation pattern of the difference values during operation is detected.

The pattern of the difference values is compared with the learning data stored in the storage 115, so that FF control calculation is performed to select the FF operation pattern in an appropriate conformity state (step S16).

PWM control on the driving motor 161 is performed (step S17). The duty ratio of the PWM control for generating a drive control signal of the driving motor 161 is controlled by FB control calculation and FF control calculation (the selected FF operation pattern).

Steps S14, S15, and S16 correspond to the FB control calculating unit 117, the integral calculating unit 118, and the FF control calculating unit 119.

As described above, in this embodiment, the pattern of difference value fluctuations detected during operation is compared with the stored learning data (sets of control data), so that the (optimum) FF operation pattern in an appropriate conformity state is selected, and FF control is performed on the motor driving the intermediate transfer belt. Thus, it is possible to perform excellent FF control without lowering productivity, and effectively reduce occurrences of color misregistration and density unevenness due to fluctuations in the moving speed of the intermediate transfer belt. In other words, it is possible to provide an image forming apparatus and an image forming program capable of effectively reducing occurrences of color misregistration and density unevenness due to fluctuations in the moving speed of the intermediate transfer belt.

Although embodiments of the present invention have been described and illustrated in detail, the disclosed embodiments are made for purposes of illustration and example only and not limitation. The scope of the present invention should be interpreted by terms of the appended claims. Various changes may be made to the present invention within the scope of the claimed invention. For example, the driving motor 161 is not necessarily controlled through FB control and FF control, but may be controlled only through FF control as needed.

It should be noted that the image forming program according to an embodiment of the present invention can also be formed with a dedicated hardware circuit. Further, the image forming program may be recorded on computer-readable recording media such as universal serial bus (USB) memories or DVD (Digital Versatile Disc)-ROMs (Read Only Memory) to be distributed. Alternatively, the image forming program can be provided online via a network such as the Internet, without the use of any recording medium. In such a case, the image forming program is normally stored in a magnetic disk device or the like forming the storage. Further, the image forming program may be provided as independent application software, or may be provided as a function incorporated into some other software.

What is claimed is:

1. An image forming apparatus comprising:

a hardware processor that performs feedforward control on a motor in synchronization with conveyance of a paper sheet on which an image is to be formed;

a driving roller that drives an intermediate transfer belt for transferring a toner image onto the paper sheet;

a drive transmission system that transmits a driving force of the motor to the driving roller;

a first detector that detects a speed of a driving shaft of the motor;

a second detector that detects a speed of a driving shaft of the drive transmission system; and a storage that stores a plurality of sets of control data having different conformity states, wherein the plurality of sets of control data include pairs of a feedforward operation pattern and a drive transmission system deformation pattern synchronized with the feedforward operation pattern, the drive transmission system deformation pattern corresponds to a fluctuation pattern of difference values between the speed of the driving shaft of the motor and the speed of the driving shaft of the drive transmission system, and the hardware processor compares the fluctuation pattern of difference values between the speed detected by the first detector and the speed detected by the second detector with the plurality of sets of control data, to select a feedforward operation pattern in an appropriate conformity state.

2. The image forming apparatus according to claim 1, further comprising a fixing roller that fixes the toner image transferred onto the paper sheet, wherein different conformity states among the plurality of sets of control data relate to sheet characteristics and/or a rotational speed of the fixing roller.

3. The image forming apparatus according to claim 2, wherein the sheet characteristics include a thickness, a weight, and frictional properties of the paper sheet.

4. The image forming apparatus according to claim 1, wherein the driving shaft of the drive transmission system is an output shaft of the driving roller.

5. The image forming apparatus according to claim 1, wherein the hardware processor selects the feedforward operation pattern in the appropriate conformity state from among feedforward operation patterns included in the plurality of sets of control data.

6. The image forming apparatus according to claim 1, wherein the hardware processor selects the feedforward operation pattern in the appropriate conformity state from among feedforward operation patterns obtained by interpolating feedforward operation patterns included in the plurality of sets of control data.

7. A non-transitory recording medium storing a computer readable image forming program for controlling an image forming apparatus that includes a motor, an intermediate transfer belt, a driving roller, a drive transmission system, a first detector, a second detector, and a storage, the image forming program causing the image forming apparatus to perform a process of performing a feedforward control on the motor in synchronization with conveyance of a paper sheet on which an image is to be formed, wherein the process includes:

driving an intermediate transfer belt with the driving roller, the intermediate transfer belt being for transferring a toner image onto the paper sheet;

transmitting a driving force of the motor to the driving roller with the drive transmission system;

detecting a speed of a driving shaft of the motor with the first detector;

detecting a speed of a driving shaft of the drive transmission system with the second detector;

storing a plurality of sets of control data having different conformity states in the storage; and selecting a feedforward operation pattern in an appropriate conformity state, the plurality of sets of control data include pairs of a feedforward operation pattern and a drive transmission system deformation pattern synchronized with the feedforward operation pattern, the drive transmission system deformation pattern corresponds to a fluctuation pattern of difference values between the speed of the driving shaft of the motor and the speed of the driving shaft of the drive transmission system, and in the selecting, a fluctuation pattern of difference values between the speed detected in the detecting with the first detector and the speed detected in the detecting with the second detector is compared with the plurality of sets of control data, to select the feedforward operation pattern in the appropriate conformity state.

8. The non-transitory recording medium storing a computer readable image forming program according to claim 7, wherein the image forming apparatus further includes a fixing roller that fixes the toner image transferred onto the paper sheet, and different conformity states among the plurality of sets of control data relate to sheet characteristics and/or a rotational speed of the fixing roller.

9. The non-transitory recording medium storing a computer readable image forming program according to claim 8, wherein the sheet characteristics include a thickness, a weight, and frictional properties of the paper sheet.

10. The non-transitory recording medium storing a computer readable image forming program according to claim 7, wherein the driving shaft of the drive transmission system is an output shaft of the driving roller.

11. The non-transitory recording medium storing a computer readable image forming program according to claim 7, wherein, in the selecting, the feedforward operation pattern in the appropriate conformity state is selected from among feedforward operation patterns included in the plurality of sets of control data.

12. The non-transitory recording medium storing a computer readable image forming program according to claim 7, wherein the feedforward operation pattern in the appropriate conformity state is selected from among feedforward operation patterns obtained by interpolating feedforward operation patterns included in the plurality of sets of control data.

* * * * *